US006315175B1

(12) United States Patent
Berger

(10) Patent No.: US 6,315,175 B1
(45) Date of Patent: Nov. 13, 2001

(54) CAB BRIM SHAPING DEVICE

(75) Inventor: Russell Berger, Needham, MA (US)

(73) Assignee: Constance F. Berger, Naples, FL (US)

( * ) Notice: Subject to any disclaimer, the term of this patent is extended or adjusted under 35 U.S.C. 154(b) by 0 days.

(21) Appl. No.: 09/758,298

(22) Filed: Jan. 10, 2001

Related U.S. Application Data

(60) Provisional application No. 60/178,428, filed on Jan. 27, 2000.

(51) Int. Cl.[7] ..... D06C 15/00
(52) U.S. Cl. ..... 223/84; 223/24
(58) Field of Search ..... 223/24, 25, 26, 223/84, 52, 1, 12, 15

(56) References Cited

U.S. PATENT DOCUMENTS

| | | | | |
|---|---|---|---|---|
| D. 368,806 | * | 4/1996 | Sparco | 223/84 |
| 4,927,063 | | 5/1990 | Fricano | 223/84 |
| 5,163,589 | | 11/1992 | Biehl | 223/24 |
| 5,533,652 | | 7/1996 | Levin | 223/84 |
| 5,634,575 | | 6/1997 | Scharrenberg | 223/84 |
| 5,685,465 | | 11/1997 | Berardis | 223/84 |
| 5,862,522 | | 1/1999 | Cho | 2/195.1 |
| 5,908,146 | | 6/1999 | Levin | 223/84 |
| 5,991,927 | * | 11/1999 | Barbaccia | 223/84 |

* cited by examiner

*Primary Examiner*—Bibhu Mohanty
(74) *Attorney, Agent, or Firm*—Barlow, Josephs & Holmes

(57) ABSTRACT

A device for reforming the brim of a cap having a flexible frame constructed of two flexible members and a third, hinged arcuate member, of rigid construction is provided. The two flexible members are attached to the top of the curved, rigid, bottom member and are maintained in a parallel relationship regardless of the degree of articulation of the bottom member around the hinge. This construction allows the user to insert a cap brim into the parallel slot and bend the device thereby imparting a variable degree of curvature to the brim of the cap. A ratchet device is connected to the bottom member to allow the device to be adjusted or set in a specific position to impart the desired curvature to the brim. In addition, the device has a mounting hook at one end for hanging so that it can be used as a storage or display device while the cap is retained therein.

21 Claims, 4 Drawing Sheets

CAB BRIM SHAPING DEVICE

This Appln claims the benefit of Prov. No. 60/178,428 filed Jan. 27, 2000.

BACKGROUND OF THE INVENTION

The present invention relates generally to a device for adding curvature to bendable structures. More specifically, the present invention relates to devices suitable for imparting additional and permanent curvature to the brim of a cap such as a baseball cap. In addition, the present invention relates to the reshaping of the brim of a cap while also providing a means for displaying or storing the cap being reshaped.

Caps are a well-known object with a fabric dome designed to be worn on the head and a brim section extending generally from the front thereof. The brim is usually fabricated from a cardboard or plastic insert over which a fabric covering is stitched. When manufactured and shipped, the brims of most caps are kept flat to facilitate packing, shipping and storage. After the cap is purchased, it is common for the brims of caps, such as baseball style caps, to be curled by the end user, to improve the ability of the brim to shade the users eyes from light and glare. In many cases, it is also highly desirable, from a fashion standpoint, to have a certain amount of curl to the brim of a cap.

Often the curl is added to the brim by manually manipulating the brim or wrapping it around a curved object with elastic bands so as to push on the edges of the brim, forcing it to bend. These methods generally produce inconsistent results and do not necessarily result in the addition of the smooth and permanent curvature that most cap wearers desire. Prior art devices, designed as an improvement over the manual shaping methods, commonly restrain the edges of the cap brim in slots while applying pressure to the top of the brim via and elasticized band. The drawback to all of those methods that apply forces to the edges of the cap brim is that those forces cause chaffing along the edges of the brim inducing premature failure of the fabric covering and frayed fabric edges at those locations.

In addition, in the prior art, several attempts have been made to create devices that impart a uniform curvature to the brim of a cap. These devices are made as metal molds, plastic frames or plastic clips with have a fixed curvature or a limited selection of preset curvature built into them and do not allow unlimited, variable curvature settings and are primarily focused on maintaining the shape of a cap brim. Since not all people desire the same amount of curvature in their cap brim and because many of these rigid devices are cumbersome, these prior art devices are undesirable to many people.

Many of the prior art devices also attempt to serve a purpose as a display device by installing several rigid frames into a larger frame thus causing an already cumbersome device to require yet more storage space.

In view of the foregoing, there is a demand for a cap brim-shaping device that creates permanent curvature in a cap brim. There is a particular demand for a cap brim-shaping device that can impart a varied amount of curvature to a cap brim without distressing the edges of the brim. In addition, there is a demand for a cap brim-shaping device that can also serve as a compact display and storage device for caps.

SUMMARY OF THE INVENTION

The present invention performs the function of adding curvature to the brim of a cap and providing a compact means of cap storage and display, while overcoming many of the disadvantages and limitations inherent in the currently available devices.

The invention is generally directed to a novel and unique cap brim-shaping device that can be easily used to add a variable amount of curvature with tailored profile to the brim of a cap, such as a baseball style cap. The device includes four interconnected parts, resulting in three longitudinal members, connected in such a way as to impart a smooth, uniform curvature to a cap brim whose profile can be varied as a function of the degree to which the device is bent. The bottom member is composed of two rigid, semi-circular parts connected together by a hinge. The intermediate member is flexible and is attached to the bottom member at intermediate tangential points, along the left and right sides of the interconnected bottom member. The left and right ends of the top member are also attached to the bottom member, in a position above the intermediate member, at the bottom member's left and right ends respectively. This geometry allows the intermediate and top members to be maintained in a parallel relationship to one another, regardless of the relative degree of bend of the device. In operation the brim of a cap is inserted between the intermediate and top members and the device is bent around the hinge point causing the intermediate and top members to clamp onto the brim and further to cause the brim to bend in smooth curved profile.

In an effort to further control the profile of the curvature imparted to the cap brim, the top member of the device can be fabricated with periodic v-grooves across its width. The size, depth and spacing of these grooves can be varied so as to make the top member more flexible in some areas and less flexible in others, thereby creating the ability to fabricate top members for generating slightly different and tailored curvature profiles. For example, the center area of the brim could be maintained with relatively shallow curvature while the edges of the brim could be curled more sharply.

A ratchet device is included on the device at the hinge point between the two parts of the bottom member. This ratchet allows the device to be locked in a pre-selected, fixed position once the cap has been inserted and the device has been bent, so as to allow the cap to remain in the desired, curved position for a long enough period of time to cause the curvature to become permanent.

As a result of this new and unique geometry, the brim of the hat is clamped between two flat members, which span across the entire width of the brim. The forces then imparted to the brim, by the device, during the curling process, are necessarily spread uniformly over the surface of the brim and not directly to the brim's edges. This feature eliminates the stresses placed directly on the edges of the fabric covering of the brim, reducing or eliminating the possibility of premature fabric failure at these locations. In addition, this feature also results in a more uniform curvature profile as the forces being applied to the brim are applied incrementally across the entire brim surface rather than simply on its edges.

Since, over time the cap brims would tend to return to their flat profile, this device is also intended to be used for cap storage as well. When stored, the cap could be clamped into the device so that the brim curvature could be maintained. A mounting hook is also molded into one end of the device to allow it to be hooked into a display rack or hung in a closet. This hook is included so as to facilitate convenient storage and display of the caps as they are clamped into the device.

It is therefore an object of the present invention to provide a device that can reshape the brim of a cap such as a baseball cap.

It is an object of the present invention to provide a cap brim-shaping device suitable for imparting additional curl to the brim of a cap.

It is a further object of the present invention to provide a cap brim-shaping device that is completely adjustable so as to allow the user to infinitely vary the amount of curl that is imparted to the brim of a cap.

Another object of the present invention is to provide a cap brim-shaping device that is self-contained and requires no additional bands or strapping to function.

It is a further object of the present invention to provide a cap brim-shaping device that is inexpensive to manufacture.

Another object of present invention is to provide a cap brim-shaping device that is easy to operate.

Another object of the present invention is to provide a cap-shaping device that can be used to store and display cape while also functioning to add or maintain curvature of a cap brim.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
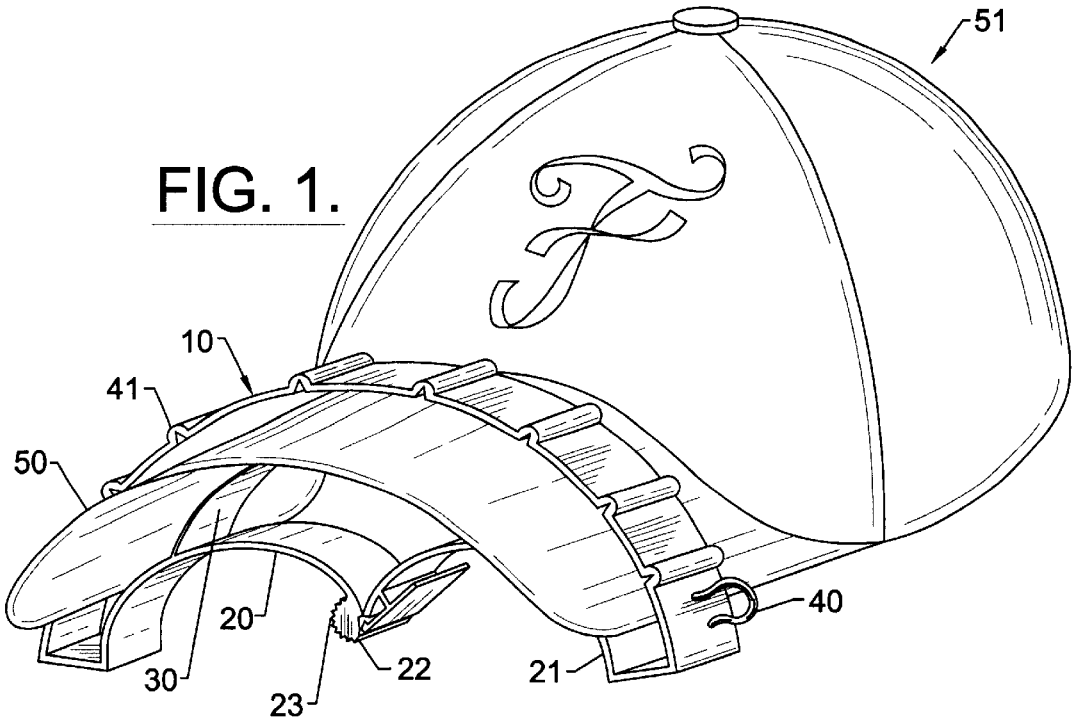
FIG. 1 is a front perspective view of the cap brim-shaping device with a cap inserted therein.

Referring first to FIG. 1, a perspective view of the cap brim-shaping device 10 of the present invention is shown. The device 10 includes a left arcuate bottom member 20 and a right arcuate bottom member 21 pivotally connected to one another by a hinge 22. The left and right ends of a flexible intermediate member 30 are attached to the bottom members 20 and 21 at their respective center portions. The left and right ends of a top member 40 are attached to the respective left and right outside ends of the bottom members 20 and 21. This construction allows a brim 50 of a cap 51 to be inserted into a gap between the top member 40 and the intermediate member 30 for shaping. A ratchet device 23 is installed proximate to the hinge 22 on the bottom members 20 and 21 so as to allow the device to be locked in various articulated positions and allow a variable amount of curvature to be added to the brim 50 being shaped. Intermediate member 30 is flexible and pushes upwardly against the bottom of brim 50 to spring-bias it against the inner surface of a top member 40. As a result, the brim 50 is maintained flush against the top member 40 thus providing a smooth desired curvature.

Figure 2:
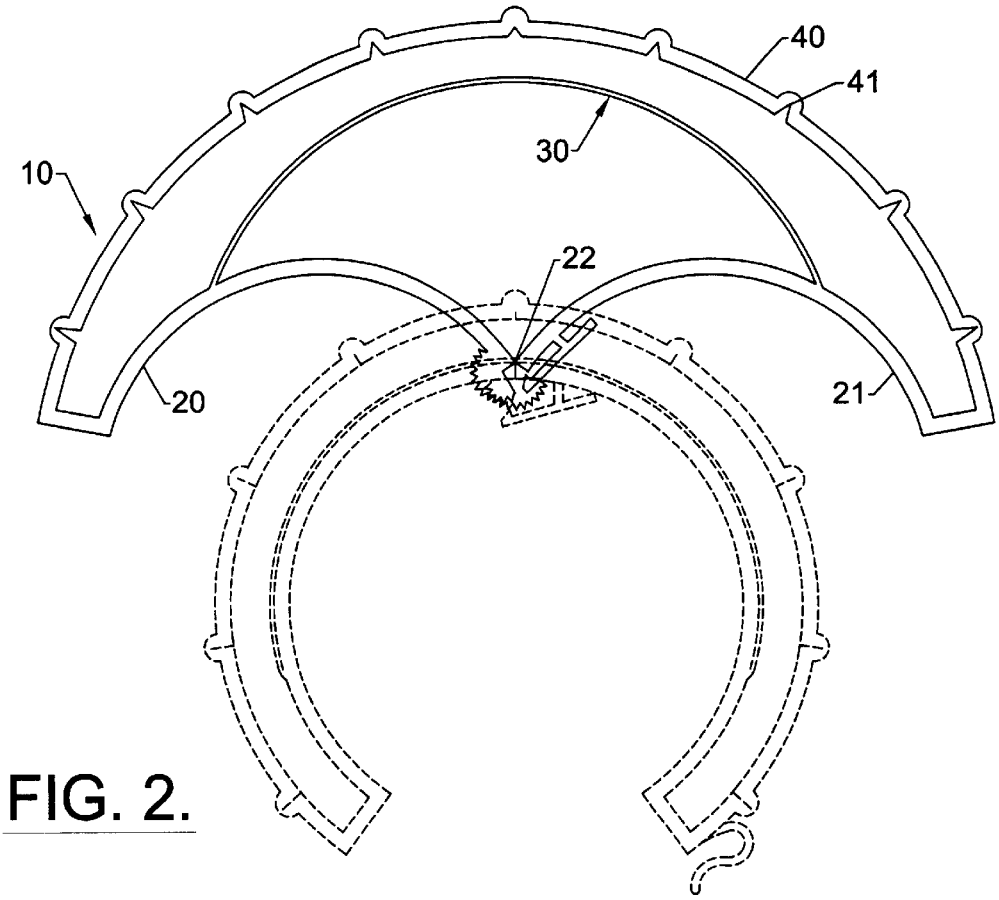
FIG. 2 is a front view of the cap brim-shaping device in the open position, with broken lines indicating the device in a fully closed position.

FIG. 2 shows the device 10 in a frontal view demonstrating the operating range of the device 10 as it is articulated around the hinge 22. The solid lines indicate the device 10 in the fully open position ready to accept insertion of a cap brim therein while the broken lines indicate a fully closed position, as would be the case when the device was being employed to impart curvature to a cap brim.

Figure 3:
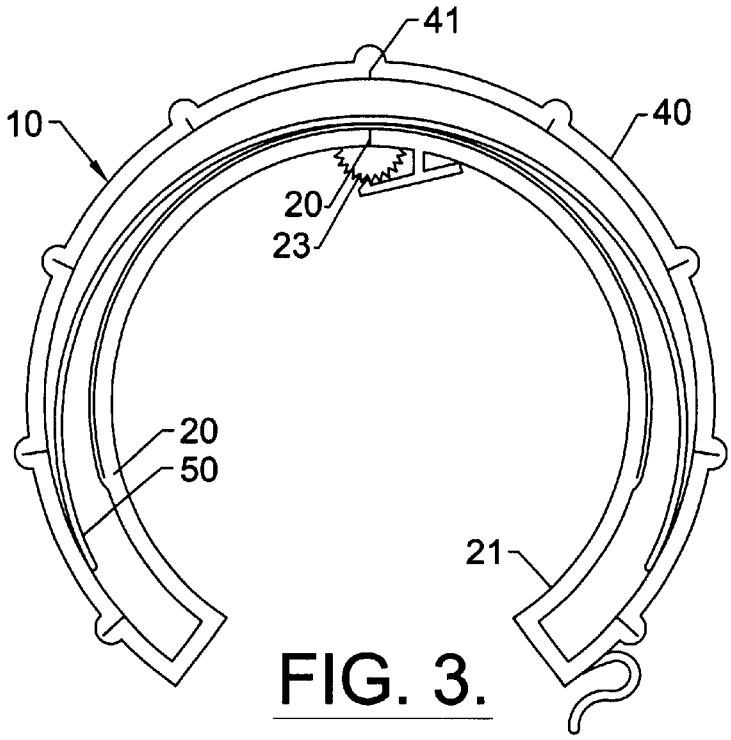
FIG. 3 is a front view the device in a closed position, with a cap inserted therein.
Figure 4:
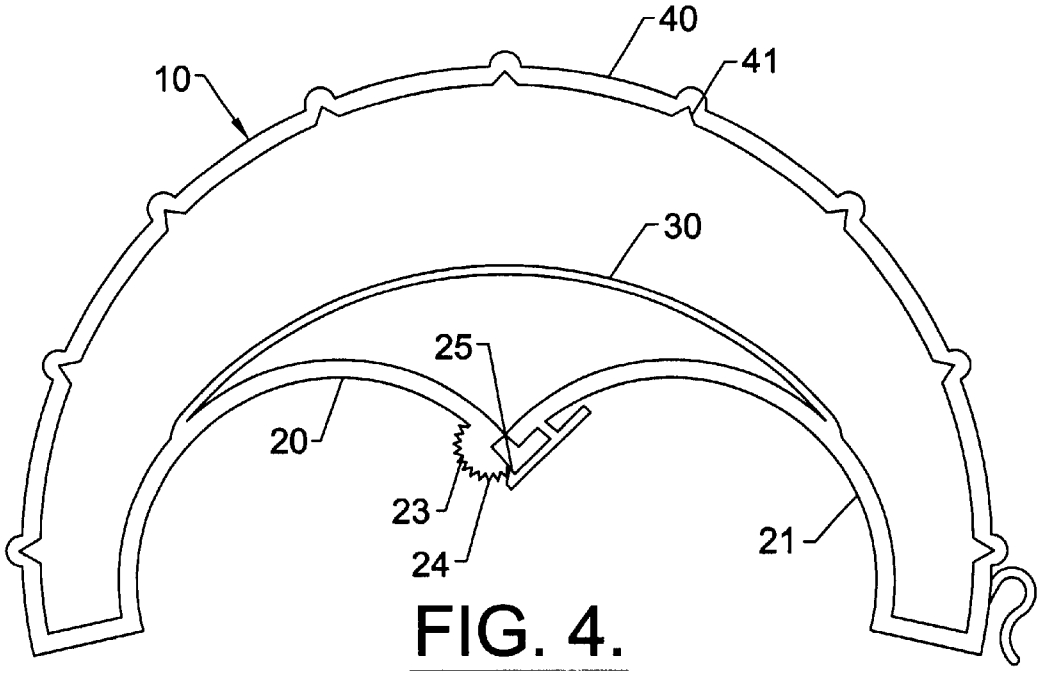
FIG. 4 is a front view of the device in a partially closed position, with a cap inserted therein.

Turning to FIGS. 3 and 4, two possible shaping positions are shown. FIG. 3 shows the device 10 fully closed with a cap brim 50 inserted, thereby imparting the maximum curvature to the brim 50. FIG. 4 shows the device 10 partially closed with a cap brim 50 inserted so as to customize the amount of curvature added to the brim 50. The device 10 can be locked in these and virtually any other articulated position via the ratchet device 23 located at the hinge point 22 of the bottom members 20 and 21. The ratchet device has a spring biased latching arm 25 that engages formed plastic teeth 24 disposed on the surface of the ratchet device 23.

Figure 5:
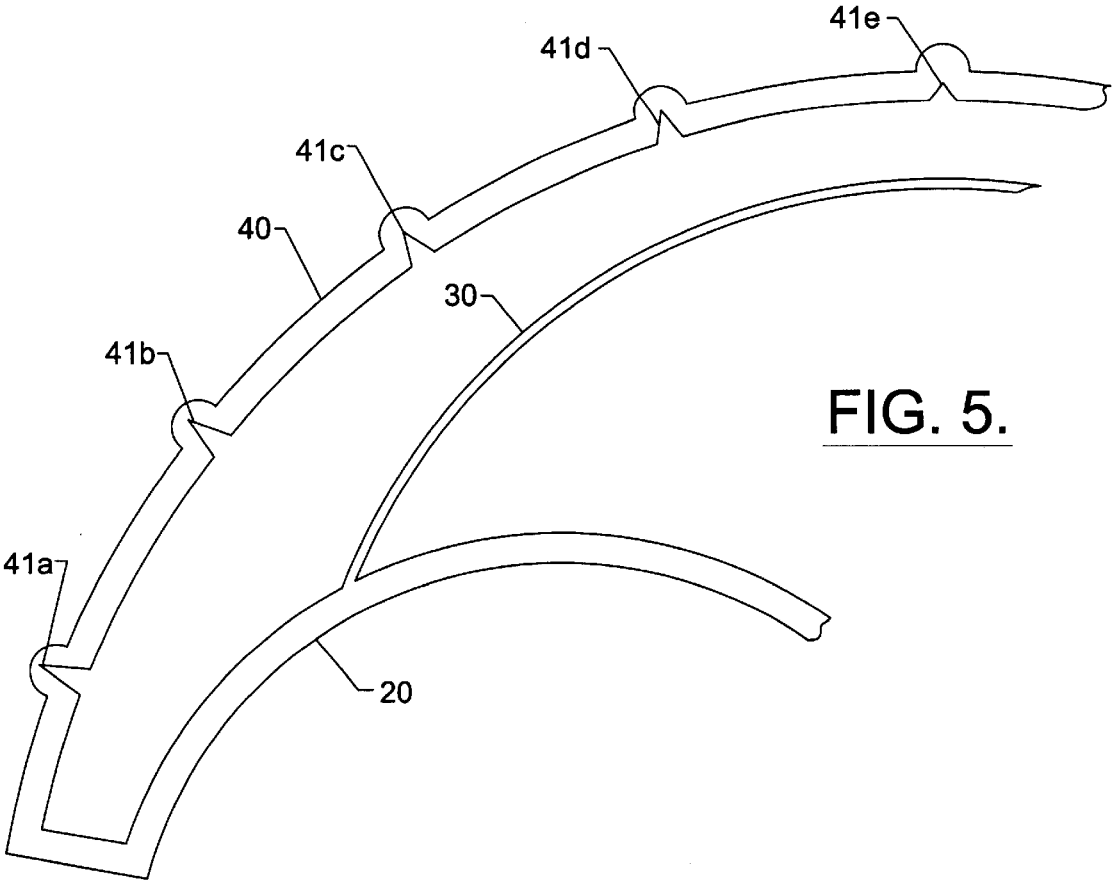
FIG. 5 is a close-up detail view of the top member of the device showing different sized v-grooves in the top member.

FIG. 5 shows a close-up view of the top member 40 with the addition of v-shaped grooves 41 which are fabricated into the top member 40 so as to introduce and additional level of control over the amount of flexibility of that member. As the device 10 is bent around the hinge 22, the v-shaped grooves 41 will provide additional flexibility in the top member 40 at their respective locations. By varying the size, depth and distribution of these v-grooves 41 along the top member 40, the curvature of the top member can be controlled to provide a uniform and smooth profile that could potentially be varied along the length of the member. For example, the center area of the brim 50 could be maintained with relatively shallow curvature while the edges of the brim 51 could be curled more sharply. For example, v-shaped grooves 41*a,* 41*b,* 41*c,* 41*d,* 41*e,* are provided where grooves 41*a* and 41*e,* on the left and right side of the device, are deeper than grooves 41*b,* 41*c* and 41*d* located in the middle portion of top member 40. With this groove profile configuration, more pressure will be required to bend the middle portion of the top member 40 then the outer portions, thus imparting more curve to the cap brim 50 at its outer edges 51 than at its center portion. The arrangement and size of the v-shaped grooves can be modified to achieve any custom brim shape. While the use of the v-shaped grooves are preferred to fully control the shape of the brim 50 to be curved, they may be omitted to facilitate manufacture or the like.

Figure 6:
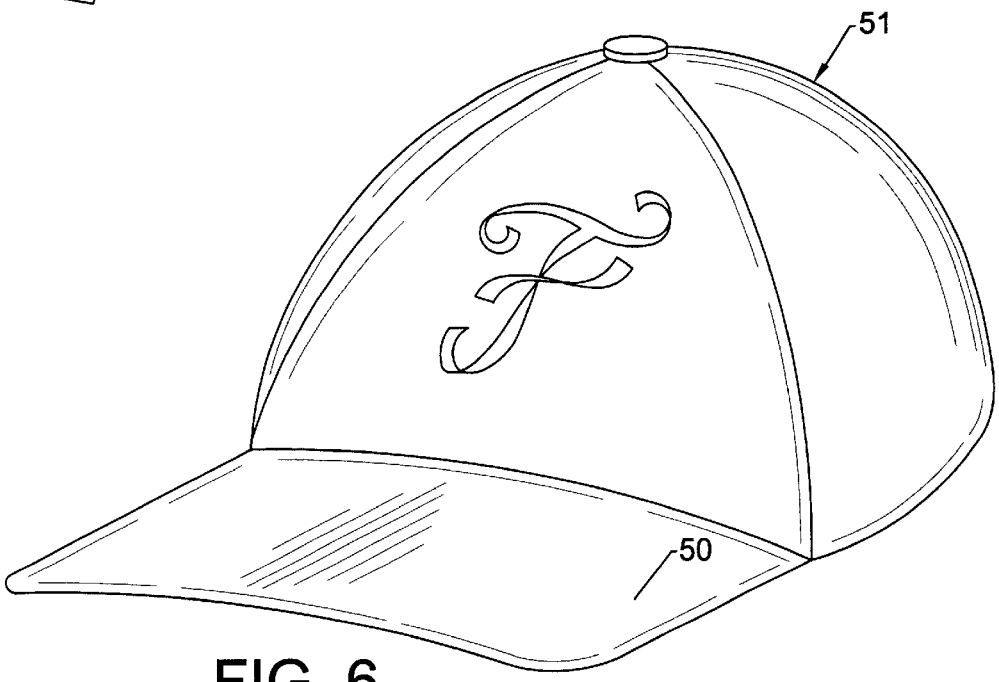
FIG. 6 is a view of a cap alone before curling of the brim.
Figure 7:
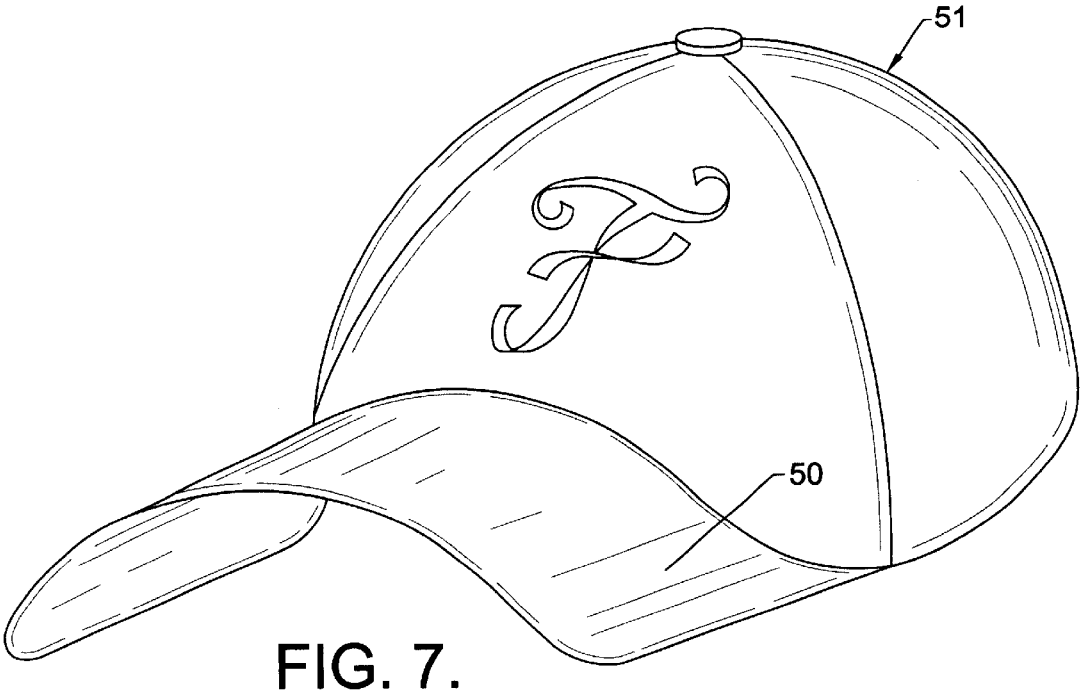
FIG. 7 is a view of cap alone after curling of the brim with the device of the present invention.

FIGS. 6 and 7 illustrate the results the device 10 is intended to achieve. FIG. 6 shows a cap 51 with a flat brim 50 as it would appear before using the device 10. FIG. 7 shows the same cap 51 with a curved brim 50 as it would appear after employing device 10 of the present invention.

It would be appreciated by those skilled in the art that various changes and modifications can be made to the illustrated embodiment without departing from the spirit of the present invention. All such modifications and changes are intended to be covered by the appended claims.

What is claimed is:

1. A device for shaping the brim of a cap, comprising:

a lower shaping member, having a first end and a second end opposite to said first end;

an upper shaping member, having a first end and a second end opposite to said first end, arranged in a spaced relationship to said upper shaping member and defining a cap brim receiving space therebetween;

an actuator member coupled to said first and second ends of said upper shaping member and said lower shaping member;

said spaced relationship being maintained by the attachment of said lower shaping member and said upper shaping member to said actuator member.

2. The device in claim 1, wherein said actuator includes two arcuate halves; said first half having a width, a first end and a second end opposite to said first end, defining an intermediate point located on said first half between said first and second ends; said second half having a width, a first end and a second end opposite to said first end, defining an intermediate point located on said second half between said first and second ends; said first and second halves being hingedly connected to one another at said second end of the first half and said first end of said second half.

3. The device in claim 2, wherein said lower shaping member is constructed of a flexible material, said first end of said lower shaping member being attached to the first half of the actuator member at said intermediate point on said first half, said second end being attached to the second half of the actuator member at said intermediate point on said second half.

4. The device of claim 1, wherein said upper shaping member includes v-shaped grooves across its width.

5. The device of claim 4, wherein said v-shaped grooves have a depth that is varied across said upper shaping member.

6. The device of claim 3, further comprising:

a ratchet device connected between the two arcuate halves of the actuator member.

7. The device of claim 6, where the ratchet device is adjustable.

8. The device of claim 1, further comprising:

a mounting hook connected to said upper shaping member.

9. A device for shaping the brim of a cap, comprising:

an actuator member having two arcuate halves; said first half being constructed of a rigid material, having a width, a first end and a second end opposite to said first end, with a first intermediate point located between said first and second ends; said second half also being constructed of a rigid material, having a width, a first end and a second end opposite to said first end, with a second intermediate point located between said first and second ends; said first and second halves being hingedly connected to one another at said second end of the first half and said first end of said second half;

a lower shaping member having a width, a first end and a second end opposite to said first end, being constructed of a flexible material, said first end of said lower shaping member being attached to the first half of the actuator member at said first intermediate point, said second end of said lower shaping member being attached to the second half of the actuator member at said second intermediate point; and, an upper shaping member having a width, a first end and a second end opposite to said first end; said first end of said upper shaping member being attached to said first end of said actuator member, said second end of said upper shaping member being rigidly attached to said second end of said actuator member with the lower shaping member residing between the upper shaping member and the actuator member.

10. The device of claim 9, wherein the upper shaping member includes v-shaped grooves across said member.

11. The device of claim 9, further comprising:

a ratchet device connected to the two halves of the actuator member.

12. The device of claim 11, wherein said ratchet device is adjustable.

13. The device of claim 9, wherein said lower shaping member is maintained in a spaced relationship to the upper shaping member, defining a cap brim receiving slot therebetween.

14. The device of claim 9, further comprising:

a mounting hook connected to said upper shaping member.

15. A cap brim shaping device, comprising:

an upper arcuate member having a first end, a second end and a degree of arc;

a lower arcuate member having a first end, a second end and a degree of arc; said first end of said upper shaping member being connected to said first end of said lower shaping member; said second end of said upper shaping member being connected to said second end of said lower shaping member; connection of said upper shaping member to said lower shaping member defining therebetween a cap brim receiving slot having an arcuate configuration;

means for changing said degree of arc of said lower arcuate member;

whereby changing said degree of arc of said lower arcuate member changes said arcuate configuration of said cap brim receiving slot.

16. The cap brim shaping device of claim 15, wherein said lower arcuate member includes a first half and a second half pivotally connected to one another by a hinge.

17. The cap brim shaping device of claim 16, further comprising a ratchet connected to said hinge.

18. The cap brim shaping device of claim 15, further comprising:

a biasing member connected to said lower arcuate member.

19. The cap brim shaping device of claim 15, wherein said upper arcuate member includes a plurality of notches therein and in spaced apart relation to one another.

20. The cap brim shaping device of claim 15, further comprising:

a hook connected to said upper arcuate member.

21. The cap brim shaping device of claim 15, further comprising:

a hook connected to said lower arcuate member.

* * * * *